US006189881B1

(12) United States Patent
Bolton et al.

(10) Patent No.: US 6,189,881 B1
(45) Date of Patent: Feb. 20, 2001

(54) SHEET DISPENSING APPARATUS AND TRAY

(75) Inventors: Roger Walter Bolton; John Gerwyn Price, both of Hants; Deborah Suzanne Taylor, West Susses, all of (GB)

(73) Assignee: De La Rue International Limited, London (GB)

( * ) Notice: Under 35 U.S.C. 154(b), the term of this patent shall be extended for 0 days.

(21) Appl. No.: 09/051,127

(22) PCT Filed: Sep. 8, 1997

(86) PCT No.: PCT/GB97/02405

§ 371 Date: May 11, 1998

§ 102(e) Date: May 11, 1998

(87) PCT Pub. No.: WO98/09899

PCT Pub. Date: Mar. 12, 1998

(30) Foreign Application Priority Data

Sep. 6, 1996 (GB) ..... 9618689

(51) Int. Cl.[7] ..... B65H 3/44; B65H 5/26

(52) U.S. Cl. ..... 271/9.04; 271/9.07; 271/9.12; 271/9.13; 271/122; 271/126; 271/157; 271/162; 271/303; 271/263; 902/15; 902/16

(58) Field of Search ..... 271/3.17, 3.19, 271/9.01, 9.02, 9.04, 9.07, 9.08, 9.12, 9.13, 122, 126, 157, 162, 263, 265.04, 303, 207; 902/14.16

(56) References Cited

U.S. PATENT DOCUMENTS

| | | | | |
|---|---|---|---|---|
| 3,760,158 | | 9/1973 | Whitehead et al. . | |
| 4,017,004 | | 4/1977 | Onoe et al. . | |
| 4,053,152 | | 10/1977 | Matsumoto . | |
| 4,222,557 | * | 9/1980 | Wu | 271/9.07 |
| 4,294,380 | * | 10/1981 | Rapkin | 221/195 |
| 4,468,068 | | 8/1984 | Kokubo et al. . | |
| 4,479,770 | * | 10/1984 | Slat et al. | 271/9.01 |
| 4,688,782 | * | 8/1987 | Browne | 271/9.07 |
| 5,076,562 | * | 12/1991 | Sai et al. | 271/9.08 |
| 5,472,183 | * | 12/1995 | Kubo | 271/126 |
| 5,573,234 | * | 11/1996 | Petocchi | 271/9.01 |
| 5,597,996 | * | 1/1997 | Flood | 902/14 |

FOREIGN PATENT DOCUMENTS

| | | | |
|---|---|---|---|
| 18557/92 | | 1/1993 | (AU) . |
| 0161742 | * | 11/1985 | (EP) . |
| 0 161 742 | | 11/1985 | (EP) . |
| 0 542 226 | | 5/1993 | (EP) . |
| 0542226A1 | * | 5/1993 | (EP) . |
| 0 600 848 A2 | | 6/1994 | (EP) . |
| 362088737 | * | 4/1987 | (JP) . |
| WO 94/14140 | | 6/1994 | (WO) . |

* cited by examiner

*Primary Examiner*—H. Grant Skaggs
(74) *Attorney, Agent, or Firm*—Oliff & Berridge, PLC

(57) ABSTRACT

A sheet dispensing apparatus includes at least one pair of sheet stores, and a transport system for transporting sheets from the stores to a dispense position. The transport system includes, for each pair of sheet stores, a common feed member which, upon relative movement between the common feed member and the stores, can be moved between a pair of feed positions in each of which it engages a sheet in a respective one of the pair of stores so as to enable sheet(s) to be withdrawn from the corresponding store. The common feed member is able to take up also a neutral position in which, even if actuated, no sheets are fed from either store.

35 Claims, 15 Drawing Sheets

SHEET DISPENSING APPARATUS AND TRAY

The invention relates to sheet dispensing apparatus, for example banknote dispensing apparatus.

Banknote dispensers are well known and typically accommodate a number of individual note storage cassettes, each of which contains one particular denomination of note. During a dispense operation, the apparatus determines the combination of notes which is required and then selects appropriate notes as required from the corresponding stores. The combination is then fed to a dispense outlet. In some cases, this requires a large volume of notes of each denomination to be stored which not only requires a large volume of space but also requires that a large value is contained within the dispenser leading to security problems.

Banknote recirculating devices have been designed which both dispense and accept banknotes. In this case, the banknotes which are accepted are fed to a common store ready for dispensing. The system has to maintain a record of the order in which the different banknotes have been stored and this is then referred to during a dispense operation. When the correct combination of notes does not exist sequentially, the intermediate notes have to be recirculated once again or fed to a reject location. This is time consuming and can result in notes being continually recirculated leading to damage and the possibility of jamming.

Some more compact feeding systems are described in U.S. Pat. No. 4,053,152 and U.S. Pat. No. 4,688,782. In each of these systems, a pair of sheet stores is provided on either side of a feed member which can be pivoted into contact with one or other of the stores so as to feed sheets from the appropriate store. The problem with this approach is inserting the feed member between the stores. Since the feed member is urged against the sheets in one or other of the stores, there is a risk of the sheets buckling or tearing during this set up process. Alternatively, each of the two sheet stores must be inserted individually whilst the feed system is actuated towards the other store or store position, or each store must be inserted substantially at right angles to the sheet feed direction.

In accordance with one aspect of the present invention, sheet dispensing apparatus comprises at least one pair of sheet stores; and a transport system for transporting sheets from the stores to a dispense position, the transport system including, for each pair of sheet stores, a common feed member which, upon relative movement between the common feed member and the stores, can be moved between a pair of feed positions in each of which it engages a sheet in a respective one of the pair of stores so as to enable sheet(s) to be withdrawn from the corresponding store, characterised in that the common feed member is able to take up also a neutral position in which, even if actuated, no sheets are fed from either store.

With this invention, the advantages of separate stores, which may be used for different denominations, and the use of a common feed member for withdrawing sheets from both stores are maintained. However, by enabling the common feed member to take up a neutral position, it is possible to insert the feed member between the pair of sheet stores without risk of sheet buckling and the like. The result of this is that the loading of sheet stores into the apparatus can be achieved in a much more automated fashion while reducing the need for operators to check that the loading process has been completed successfully.

In some cases, the pair of sheet stores can be located manually relative to the common feed member so that thereafter the relative positions of the common feed member and the stores can be adjusted in accordance with the store from which sheets are to be withdrawn.

In accordance with a second aspect of the present invention, sheet dispensing apparatus comprises at least one pair of sheet stores; and a transport system for transporting sheets from the stores to a dispense position, the transport system including, for each pair of sheet stores, a common feed member which, upon relative movement between the common feed member and the stores, can be moved between a pair of feed positions in each of which it engages a sheet in a respective one of the pair of stores so as to enable sheet(s) to be withdrawn from the corresponding store and is characterised in that the apparatus further comprises an adjustment system for causing relative bodily movement between the stores and the common feed member so that the stores and the common feed member can be arranged relative to each other in a first position to enable the common feed member to be moved into engagement with sheets in either store, and in a second position in which the common feed member cannot be moved into engagement with sheets in either store.

With the first and second aspects of this invention, the advantages of separate stores for different sheet types and the use of a common feed member for withdrawing sheets from both stores are maintained.

In the sheet dispensing apparatus according to the first aspect of the invention, the common feed member is able to take up a neutral position whilst in the sheet dispensing apparatus according to the second aspect of the invention the feed member can be decoupled from the driving mechanism. Accordingly, in both cases it is possible to insert the feed member between the pair of sheet stores without risk of sheet buckling and the like. This is by virtue of the sheets been unable to engage a fixed feed member surface.

The result of this is that the loading of sheet stores into the apparatus can be achieved in a much more automated fashion while reducing the need for operators to check that the loading process has been completed successfully.

In the preferred arrangement, the apparatus according to the first aspect of the invention further comprises an adjustment system for causing relative bodily movement between the stores and the common feed member so that the stores and the common feed member can be arranged relative to each other in a first position to enable the common feed member to be moved into engagement with sheets in either store, and in a second position in which the common feed member cannot be moved into engagement with sheets in either store. The provision of such an adjustment system allows the stores automatically to be located relative to the common feed member in the first position. It also allows the stores more easily to be loaded into the remainder of the apparatus at the second position without risk of interference from the common feed member.

Most conveniently, in the second position the stores can be laterally removed from the remainder of the apparatus. In one example, the lateral direction may be substantially vertical but in the preferred example, the lateral direction is substantially horizontal.

The or each pair of stores may be provided individually but a much simpler approach can be achieved when the or each pair of stores is provided in a tray slidably mounted relative to the common feed member. Not only does this simplify the construction and handling of the stores but in addition simplifies the form of the adjustment system. Thus, in the preferred arrangement, the adjustment system comprises one or more pivoted arms coupled with a drive motor operable selectively to pivot the arms so as to cause bodily movement of the stores to the first position.

Where the stores are provided on a common tray, only a small number of pivoted arms is required for the adjustment system to cause all the stores to be moved to the first position.

Where the adjustment system moves the stores vertically from the second to the first position, further pivoting of the arms back to their initial position will allow the stores to return to the second position under gravity. Alternatively, some form of additional movement device is preferably provided to cause the stores to move back to the second position. This might be additional pivoted arms, a compression spring or the like.

Although the invention is applicable for use with a single pair of sheet stores, typically, more than one pair of sheet stores and associated common feed members are used, for example three pairs of sheet stores.

In many cases, the sheets in the different stores will have different dimensions in the sheet withdrawal direction. For example, typical currencies include banknotes whose sizes differ depending on their denomination. It is important, therefore, that the sheets in each store are correctly located relative to the common feed member to ensure that the common feed member can withdraw sheets from the store. It is possible to correctly locate sheets resting on a base common to each store by automatically adjusting the position of the common base relative to the common feed member. Preferably, however, each store has a base which is adjustable so as to adjust the location of sheets in the store relative to the common feed members. Typically, the base will be defined by a U-shaped member slidably mounted to a surrounding support so that it can be adjusted to different positions.

In a further alternative, a single common feed member may be provided which can be moved and inserted between any pair of sheet stores so that sheets can be fed from any of the stores. Likewise, a single common feed member could be used and the individual pairs of stores moved to insert the feed member between any pair of stores.

The stores may contain the same type of sheet but typically will contain sheets which differ between stores. For example, the stores may contain stacks of banknotes, each store corresponding to a different denomination.

The common feed member can be formed by one or more rollers or any other conventional feed device such as conveyor belts and the like. In the case of a roller, preferably the roller has a high friction surface. Typically, the common feed member is connected to a drive motor for rotation in either direction depending on the store from which sheets are to be withdrawn. This is a particularly simple arrangement allowing sheets to be withdrawn from either store simply by reversing the rotational direction of the roller.

In order to cause relative movement between the common feed member and the stores, in one example the common feed member is movable between the stores. For example, the common feed member could be mounted on a pivoted link or the like for movement between the stores and engagement with a stack of sheets in the selected store.

Typically, each store comprises a support plate and a pressure member for urging a stack of sheets in the store against the support plate. Although usually the support plate will be fixed, the support plate could be movable to bring the selected stack into contact with the common feed member. This provides an alternative way of selecting the stack from which sheets are to be withdrawn. In addition, the support plate may be pivoted to the tray so as to pivot from side to side within predetermined limits to assist in locating the plate relative to the common feed member. Conveniently, the apparatus further includes guides to locate the support plate relative to the common feed member.

In a further alternative, the stores could be bodily movable to bring the respective stacks into engagement with the common feed member.

The pressure member can take any conventional form and will typically comprise a plate and an associated urging mechanism such as a spring.

It is important to ensure that only single sheets are fed through the transport system and various known sheet separator mechanisms can be used. In the preferred example, the transport system includes a sheet separator roller system downstream of the common feed member to prevent more than one sheet from being fed, the sheet separator roller being mounted for rotation in either direction dependent on the store from which sheets are withdrawn. This provides a very simple way of ensuring that only single sheets are fed through the transport system.

Conveniently, the apparatus further comprises a reject location to which rejected sheets can be selectively fed by the transport system. These sheets may have been rejected for failure to pass certain validity tests during their passage through the transport system, or because the operator or operating system decided to abort the dispense operation.

In a particularly preferred application, the apparatus includes a drawer positioned at the reject location, and means for monitoring the position of the drawer, the monitoring means being connected to a control system of the transport system, the control system only allowing the transport system to be operated when the drawer is partially open.

This application of the apparatus is particularly useful in teller applications where the drawer is conveniently divided into two parts, a front part for the manual disposal of coins and other currency or documentation and a rear part for receiving rejected sheets. The teller will close the draw when the system is not to be used thus at the same time preventing access to the front part.

Typically, where more than one pair of sheet stores is provided, withdrawn sheets from any of the stores will be fed along substantially the same path of the transport system.

In accordance with a third aspect of the present invention, a sheet storage tray comprises a base; and at least two sheet stores spaced apart along the base, each store including an upright support plate, and a pressure member for urging a stack of sheets along the base against the support plate. Previously, sheet stores or cassettes have only included a single storage location. This alternative approach allows batches of different denominations of banknotes for example to be stored separately within the same tray allowing much easier handling and more flexibility in the combinations of sheets which can be dispensed.

Typically, the support plates of a pair of stores are positioned adjacent one another but spaced apart. This is particularly advantageous if the tray is to be used with apparatus according to the first aspect of the invention.

An example of a banknote dispenser and a tray according to the invention will now be described with reference to the accompanying drawings, in which.

Figure 1:
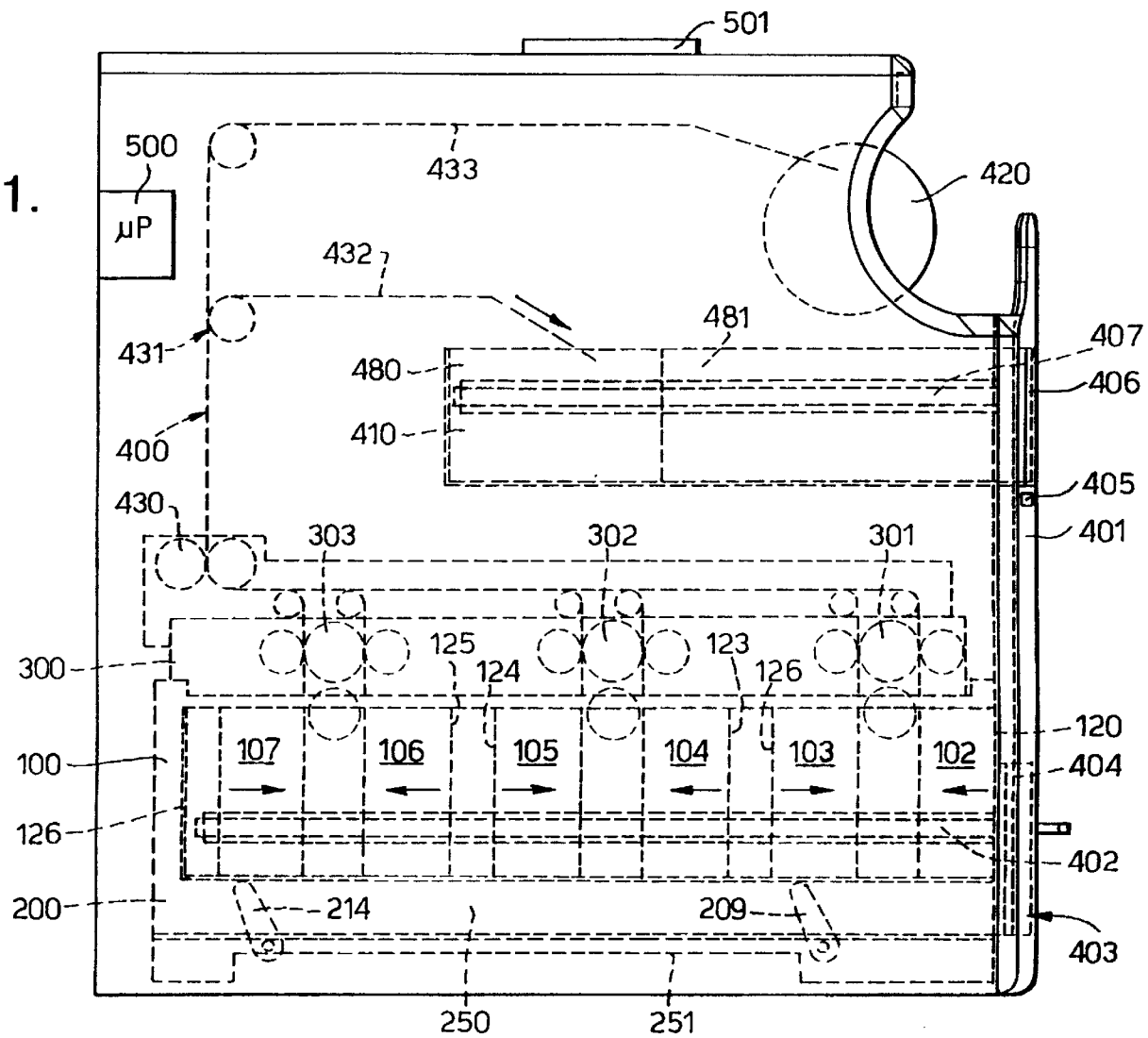
FIG. 1 is a schematic side view of the apparatus.

The teller cash dispenser shown in the drawings has a modular construction including a lifting module 200 within which a tray 100 is removably located, a sheet withdrawal module 300 positioned above the lifting module 200 for withdrawing sheets from stores in the tray 100, and a sheet transport module 400 positioned above the module 300 and including a reject tray 410 for transporting sheets from the withdrawal module 300 to a dispense outlet 420 or to the reject tray 410. The modules are all located in a secure housing 1 to which access is gained via a door 401.

Tray

The construction of the tray 100 is shown in FIGS. 10, 11 and 13 to 15. The tray 100 comprises an open top, rectangular box 101 having a base 101A, side walls 101B and end walls 101C partitioned into six compartments which will form respective stores 102–107. Partitioning is achieved by three separator plates 110–112 each having a U-shaped upper section 11OA–112A. Each arm of the U is provided with two pairs of slots 110B–110E;111B–111E;112B–112E which allow a feed member, to be described below, to gain access to sheets held within the respective compartments.

Each separator plate 110–112 is pivotably mounted to the base 101A. This can be seen in FIG. 13–15 in relation to the separator plate 110. Each separator plate, such as the plate 110, includes a recess 170 which receives a pivot 171 mounted in a support block 172 secured to the base and side wall 101A, 101B of the tray 100. A similar pivot is provided opposite to the pivot 171 to secure the other side of the plate 110. In order to limit pivotal movement of the plate 110, a pair of stops 173,174 are mounted in the side plate 101B on either side of the plate 110, and arranged to engage respective flanges 175,176 secured to and extending laterally from the plate 110. These flanges 175,176 also have a pair of upwardly facing shoulders 177,178 respectively. The function of these shoulders will be described below.

Figure 10:
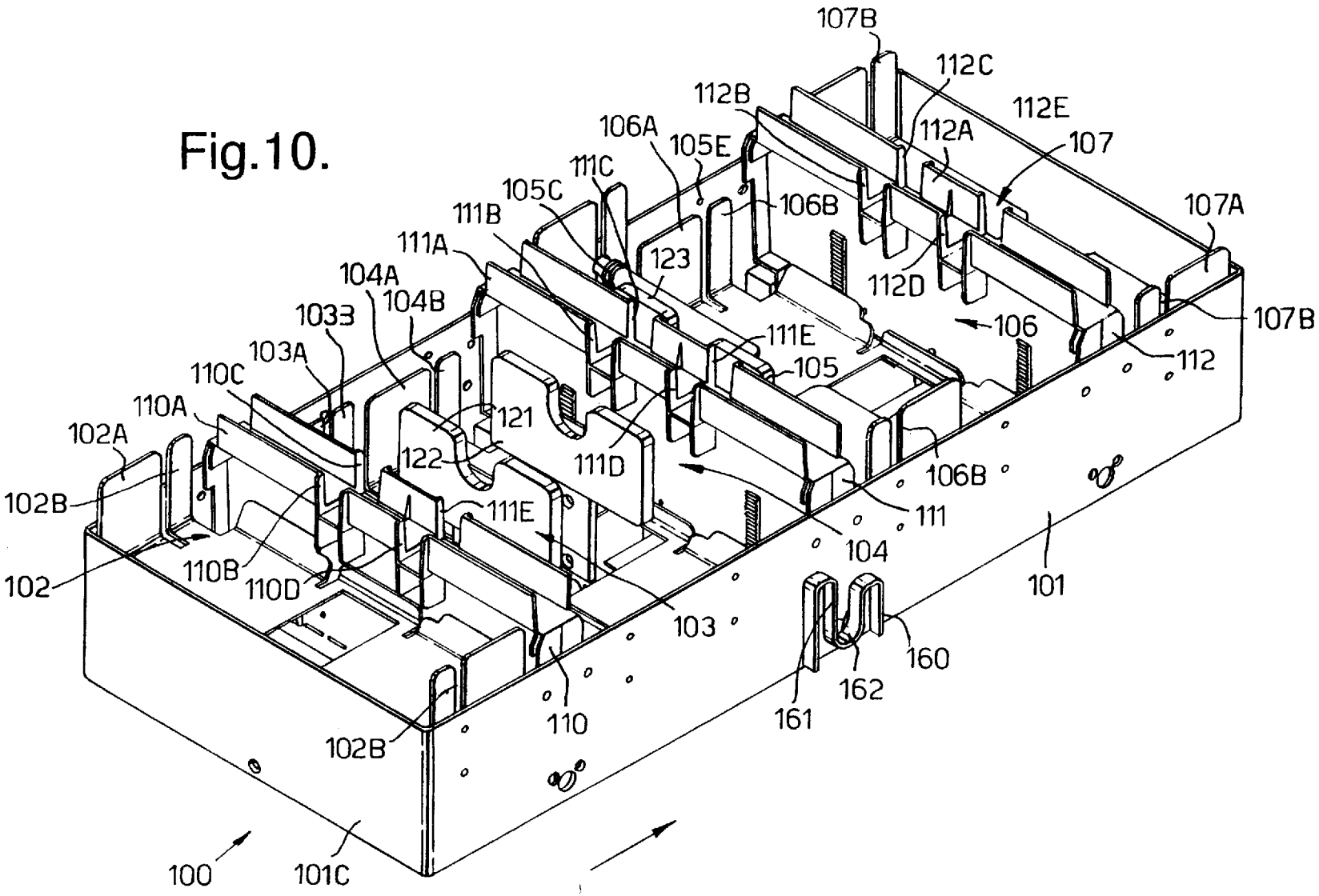
FIG. 10 is a perspective view from above, the front and the right side of a tray to be located in the lifting module, some parts being omitted for clarity.

The base of each compartment is defined by a respective generally U-shaped plate 102A–107A (not shown in FIGS. 13–15), the arms of each plate having a slot 102B–107B via which the plates are secured to the main body of the tray 101. This can be seen more clearly in FIG. 11 where the base 105 is shown secured in place via a knob 105C which has an externally screw threaded shaft which locates within a screw threaded aperture 105E in the wall of the tray 100 (FIG. 10). A spigot 105D is provided in alignment so as to provide additional securement of the tray in certain positions. The spigot 105D will protrude through the slot 105B when the tray 105A is suitably positioned. For clarity, the other knobs used to secure the trays have been omitted in FIG. 11.

The reason for providing the adjustable bases 102A–107A is to enable the tray to accommodate different size sheets. Thus, for sheets which have a small dimension in the vertical direction, the appropriate base 102 will be raised while for larger sized sheets, the base will be lowered. In general, however, it is intended that the upper edge of the sheets will lie on a substantially common plane.

Figure 11:
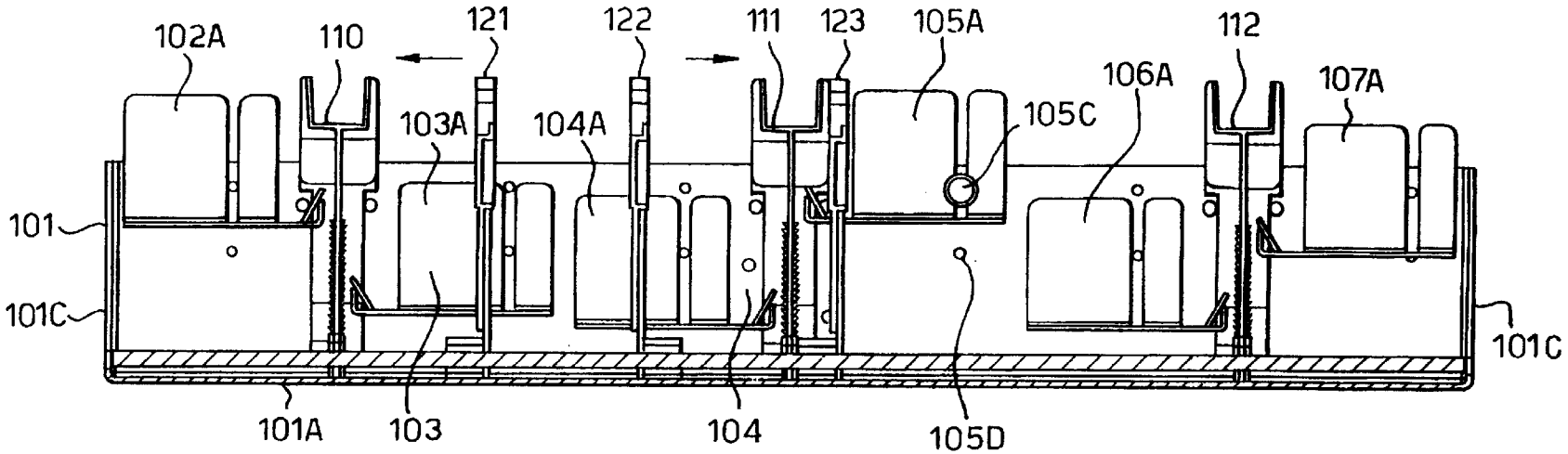
FIG. 11 is a longitudinal section in the direction X in FIG. 9 through the tray shown in FIG. 10.
Figure 12:
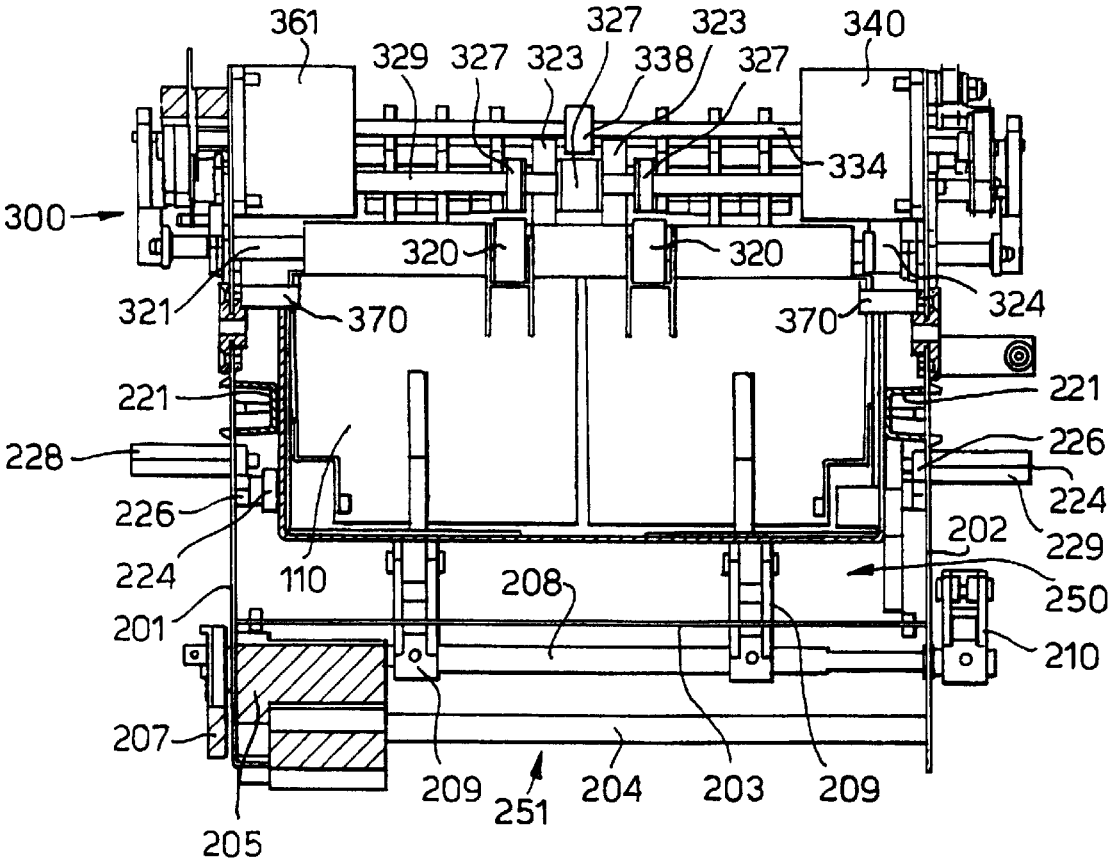
FIG. 12 is a section on the line Y—Y in FIG. 6 through the tray when assembled in the lifting module, some parts being omitted for clarity.
Figure 13:
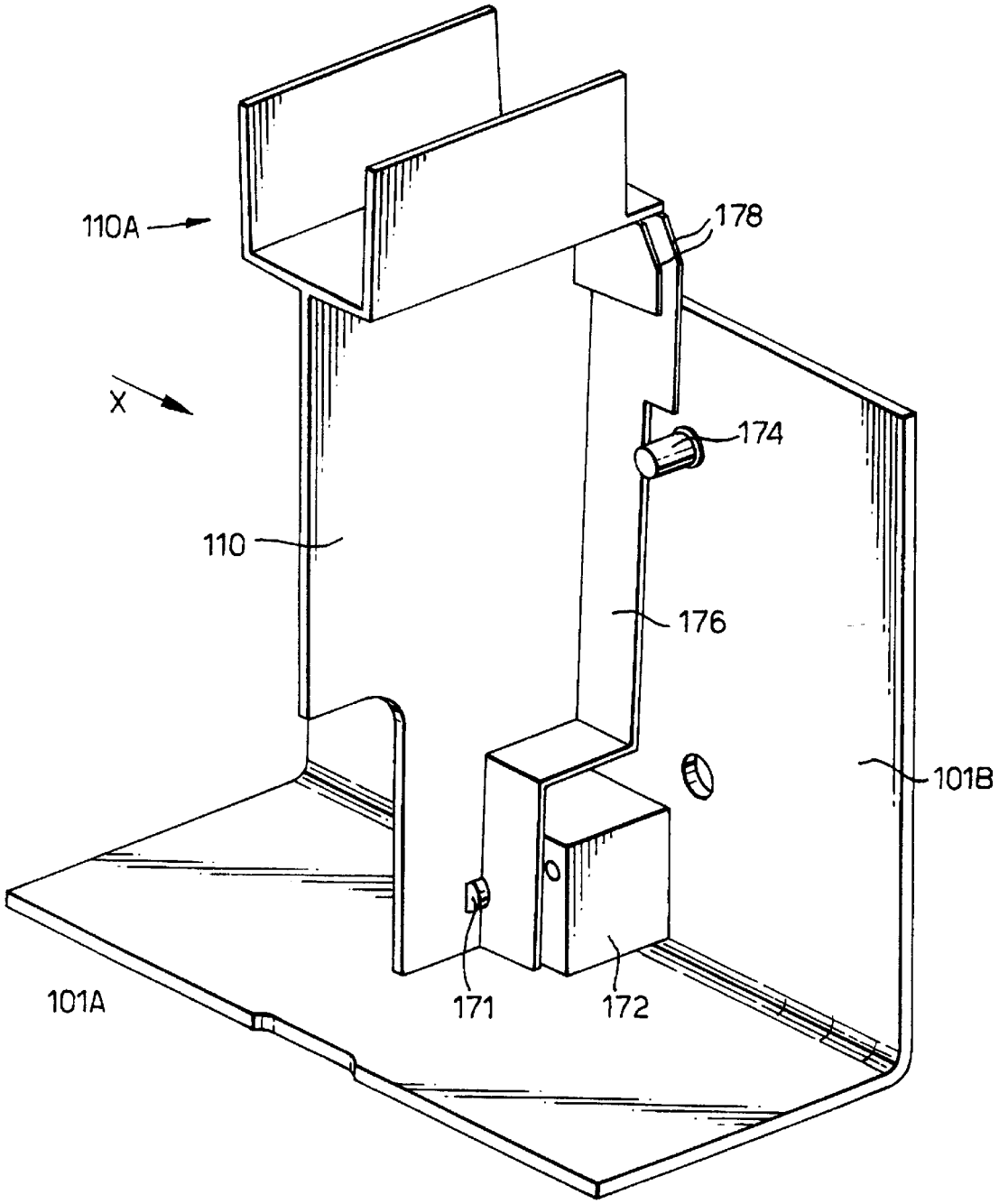
FIG. 13 is a perspective view of part of the tray shown in FIG. 10.
Figure 15:
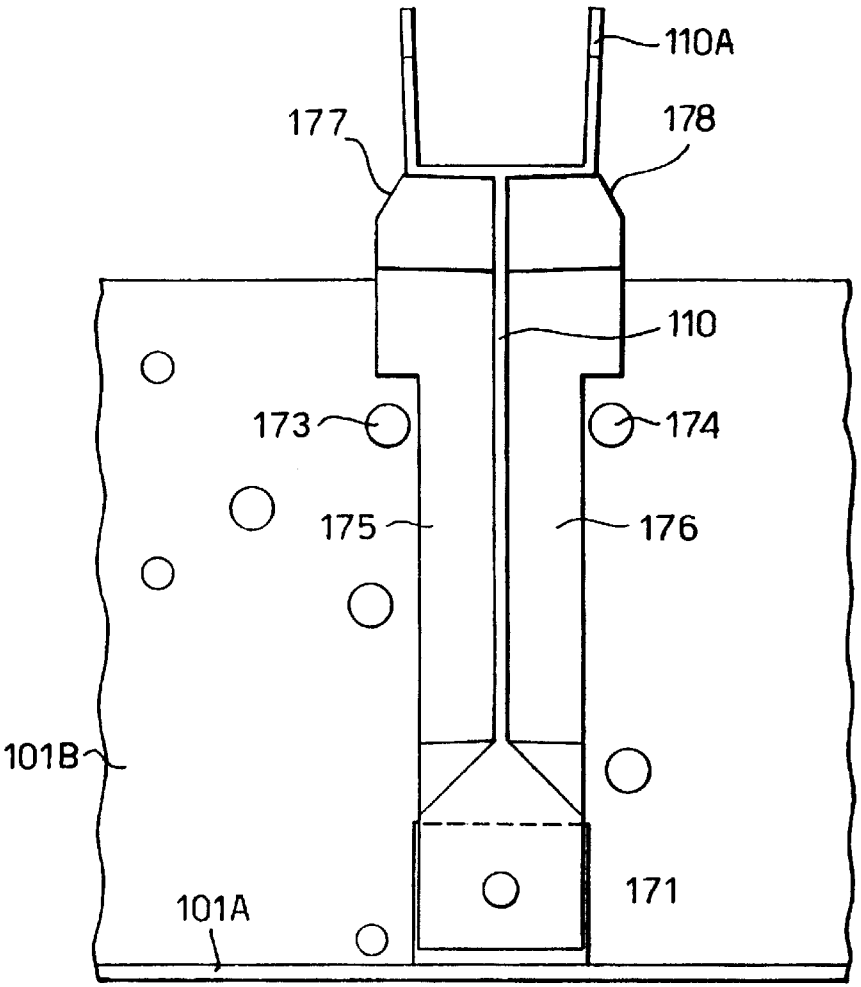
FIG. 15 is a side elevation of the portion shown in FIG. 13.
Figure 14:
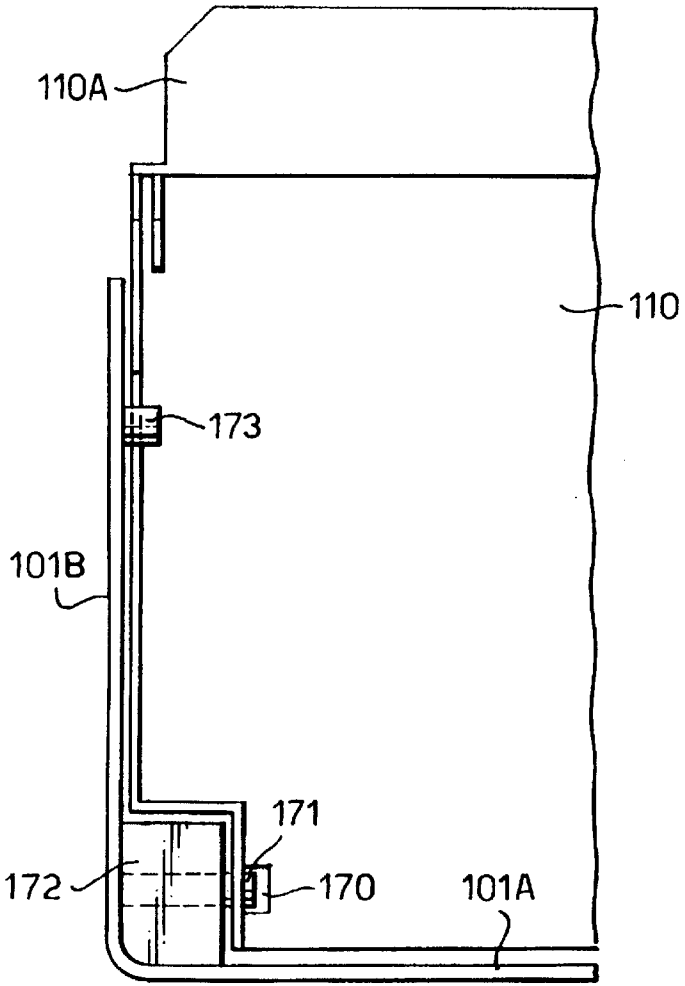
FIG. 14 is a view taken in the direction X in FIG. 13.

In order to retain the sheets in each compartment and urge them towards the respective arm of the plates 110, a set of six pressure plates 120–125 is provided, one for each compartment. For clarity, only the plates 121–123 are shown in FIGS. 10 and 11. Each plate is urged towards the adjacent side of the adjacent separator plate 110–112 by means of a tension spring or the like as is well known to those skilled in the art, so as to sandwich a stack of banknotes between them.

The pressure plates 121,122 are shown in the position they would take up if a stack of sheets were provided in the respective compartments 103,104 while the pressure plate 123 is shown engaging the plate 111 as will happen when there are no sheets remaining in the compartment 105.

On opposite sides of the tray 101 are provided respective mouldings 160 each having an open location slot 162 with a stop face 161 forming one side of the slot 162 and being longer than the opposite face of the slot. The purpose of these mouldings 160 will be explained in more detail below.

Conveniently, a handle (not shown) is attached to the end of the box 101 to assist with the insertion and removal of the tray from the lifting module 200.

Lifting Module

Figure 9:
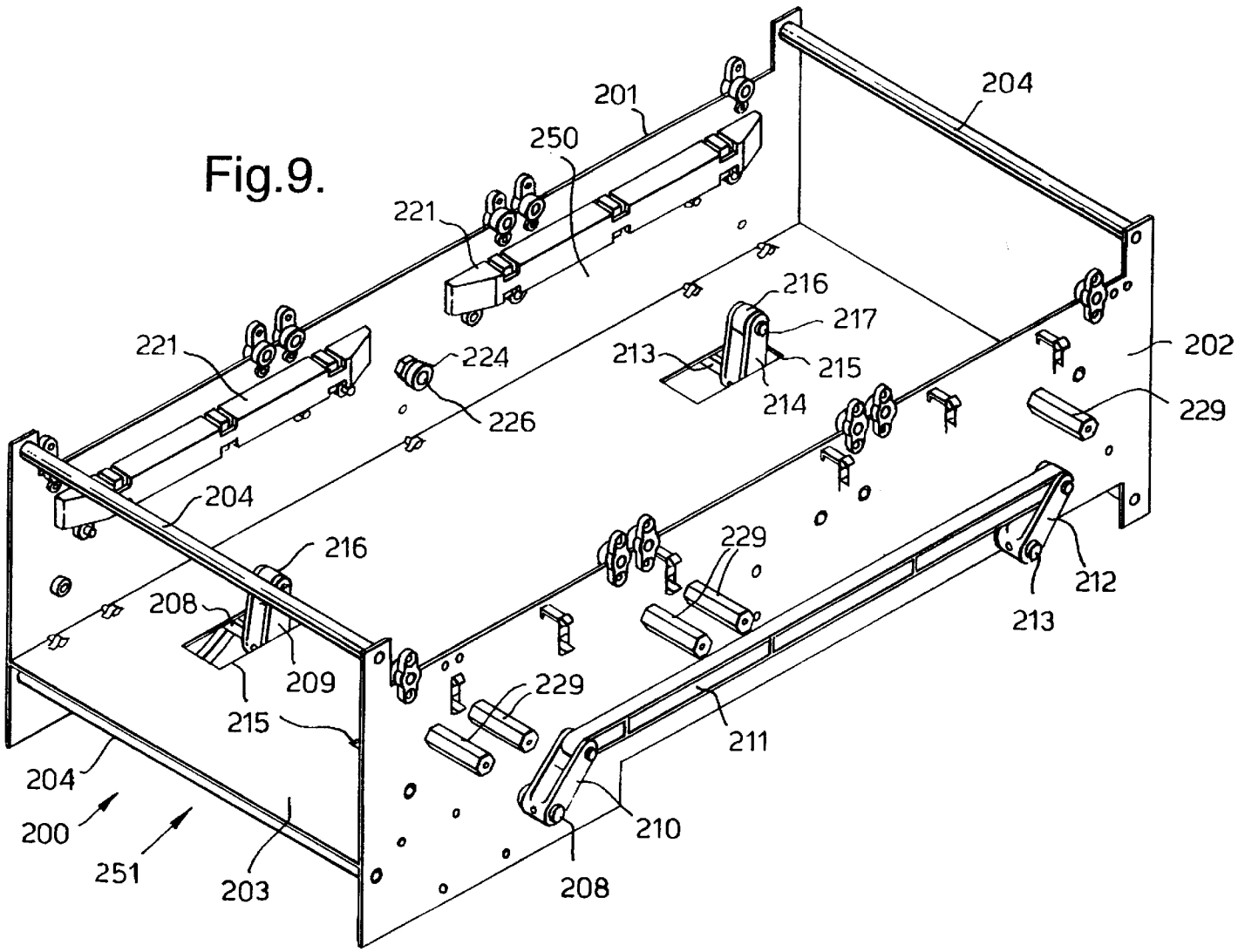
FIG. 9 is a perspective view from above, the front and the right side of the lifting module shown in FIG. 5.

An adjustment system including a lifting module is provided to lift the tray 100 into its operative, first position at which sheets can be withdrawn from the stores 102–107. The lifting module 200 is shown schematically in FIGS. 1, 3 and 4 and in more detail in FIGS. 5–7, 9 and 12. As can be seen most clearly in FIG. 9, the lifting module 200 comprises a pair of left and right side plates 201,202 spaced apart by cross bars 204, and a floor 203 which divides the lifting module into an upper section 250 and an under floor section 251. Attached to the inner faces of the side plates 201,202 are two opposed pairs of retainers 221, two of which can be seen in FIG. 9. In addition, a pair of shafts 226 are mounted on the inner faces of the opposite side walls 201,202, each carrying a rotatable locater 224.

Beneath the floor 203 in section 251 are a pair of shafts 208,213 on which two pairs of lifting arms 209,214 are non-rotatably mounted. The lifting arms 209,214 extend from the shafts 208,213 respectively through slots 215 in the floor 203 into the upper section 250. Each lifting arm 209,214 includes a roller 216 rotatably mounted to the lifting arm via a shaft 217 to which the roller is rotatably mounted.

A linking mechanism connects the two shafts 208,213 together, the mechanism comprising a link arm 210 connected non-rotatably to the shaft 208, a link arm 212 non-rotatably mounted to the shaft 213 and a connecting member 211 rotatably coupled between the link arms 210, 212.

A gear segment 207 (FIGS. 6 and 12) is non-rotatably mounted to the shaft 208 adjacent the outer face of the side plate 201, the gear segment meshing with a gear 206 non-rotatably mounted to a shaft which is driven by a geared control motor 205 mounted on the inner face of the side plate 201 beneath the floor 203.

Attached to the outer faces of the side plates 201,202 are a number of support spacers 228,229 which attach to the inner members of a pair of opposed slides 402 (FIG. 1) mounted on the main casing 1 to enable the lifting module 200 to be slid in and out of the casing 1.

Withdrawal Module

The withdrawal module 300 is shown schematically in FIGS. 1–4 and in more detail in FIGS. 5–8. As shown, the withdrawal module 300 comprises three substantially identical sets of components 301–303, each corresponding to one of the pairs of stores 102,103;104, 105;106,107. For simplicity, we will describe the set of components 301 associated with the stores 102,103. The corresponding components in the other sets will not be labelled although it should be clear from the drawings how they are constructed following a description of the set of components 301.

Figure 5:
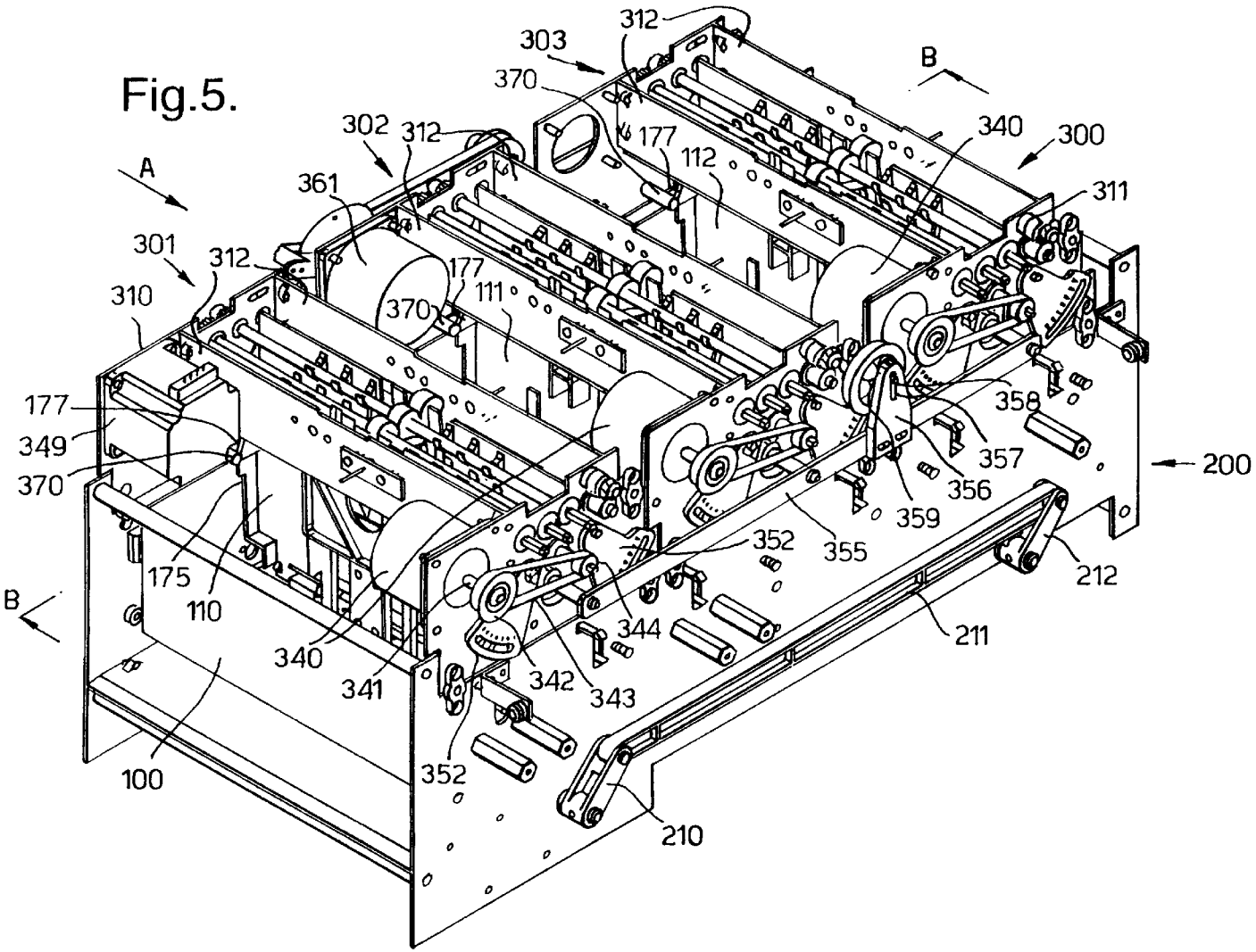
FIG. 5 is a perspective view from above, the front and the right side of the apparatus with the transport module removed.
Figure 8:
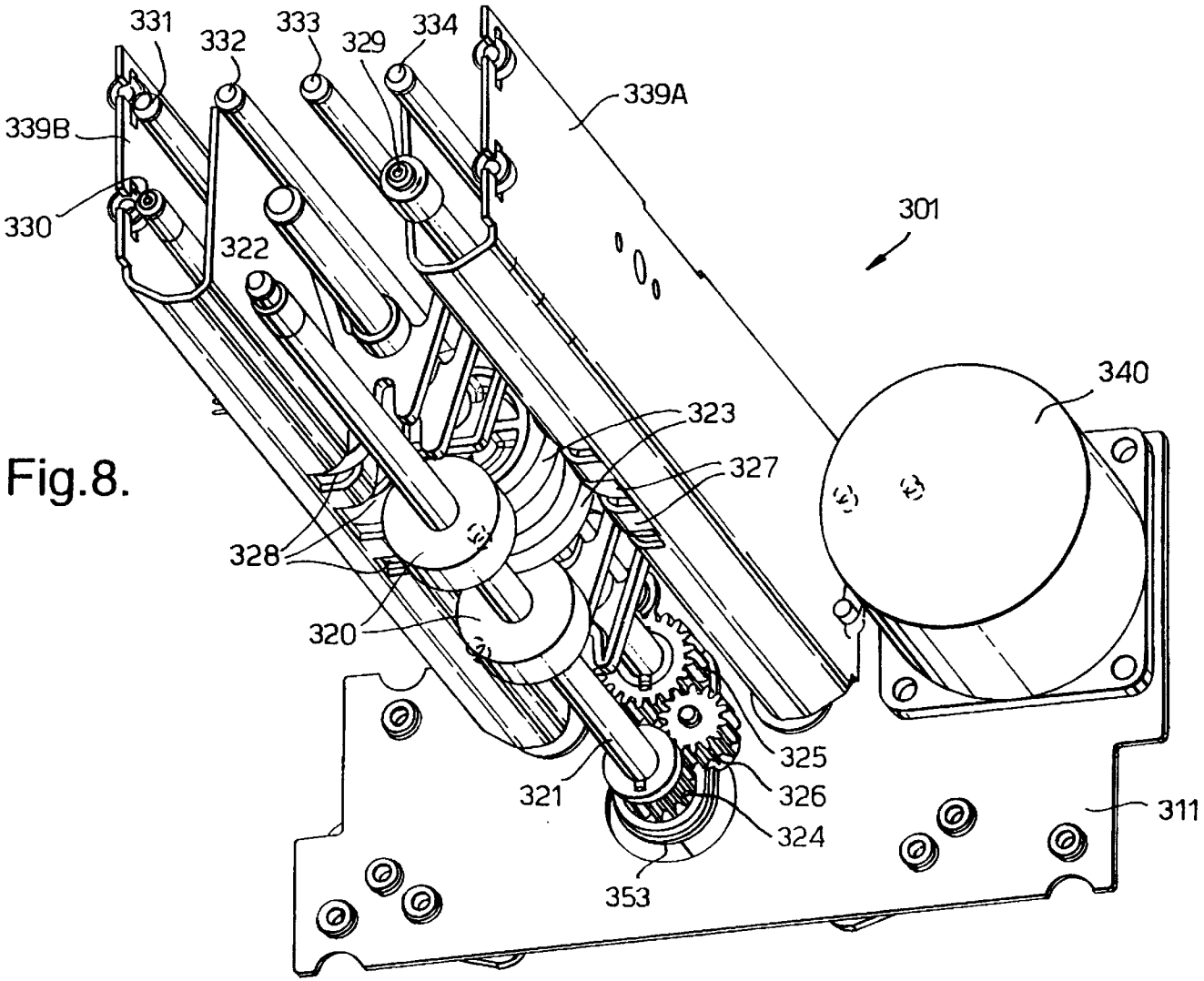
FIG. 8 is a perspective view from below of part of the apparatus shown in FIG. 5.

As can be seen most clearly in FIG. 5, the withdrawal module comprises left and right support plates 310,311 held apart by a number of spacer plates 312. As shown in FIG. 8, the set of components 301 comprise a pair of common feed rollers 320 mounted non-rotatably to a shaft 321 extending between the side plates 310,311. The rollers 320 are constructed of rubber or plastic with a high friction circumferential surface. Mounted above the shaft 321 is a shaft 322 on which are non-rotatably secured a pair of separator rollers 323. The shaft 321 is geared to the shaft 322 via respective gears 324,325 and an interconnecting gear 326.

On either side of the separator rollers 323 are sets of contra-rotating rollers 327,328 non-rotatably mounted on respective shafts 329,330. Each contra-rotating roller 327, 328 overlaps the adjacent separator roller 323 so as to cause a sheet to concertina as it passes between them. Two pairs of further feed rollers are mounted above the roller 323 on shafts 331–334. These rollers are formed in pairs 335, 336;337,338. As can be seen in FIG. 8, a pair of guide plates 339A,339B are provided for guiding sheets which are being fed by the rollers, these guide plates being omitted in FIG. 2 for clarity.

A motor 340 is mounted on the inside surface of the side plate 311 and has a drive shaft 341 which passes through the side plate 311 and on which a pulley 342 is non-rotatably mounted. The pulley 342 is connected via a drive belt 343 to a pulley 344 non-rotatably mounted to the shaft 322. It will be seen, therefore, that activation of the motor 340 will cause rotation of the shaft 322 and corresponding rotation in the same sense of the shaft 321.

Figure 6:
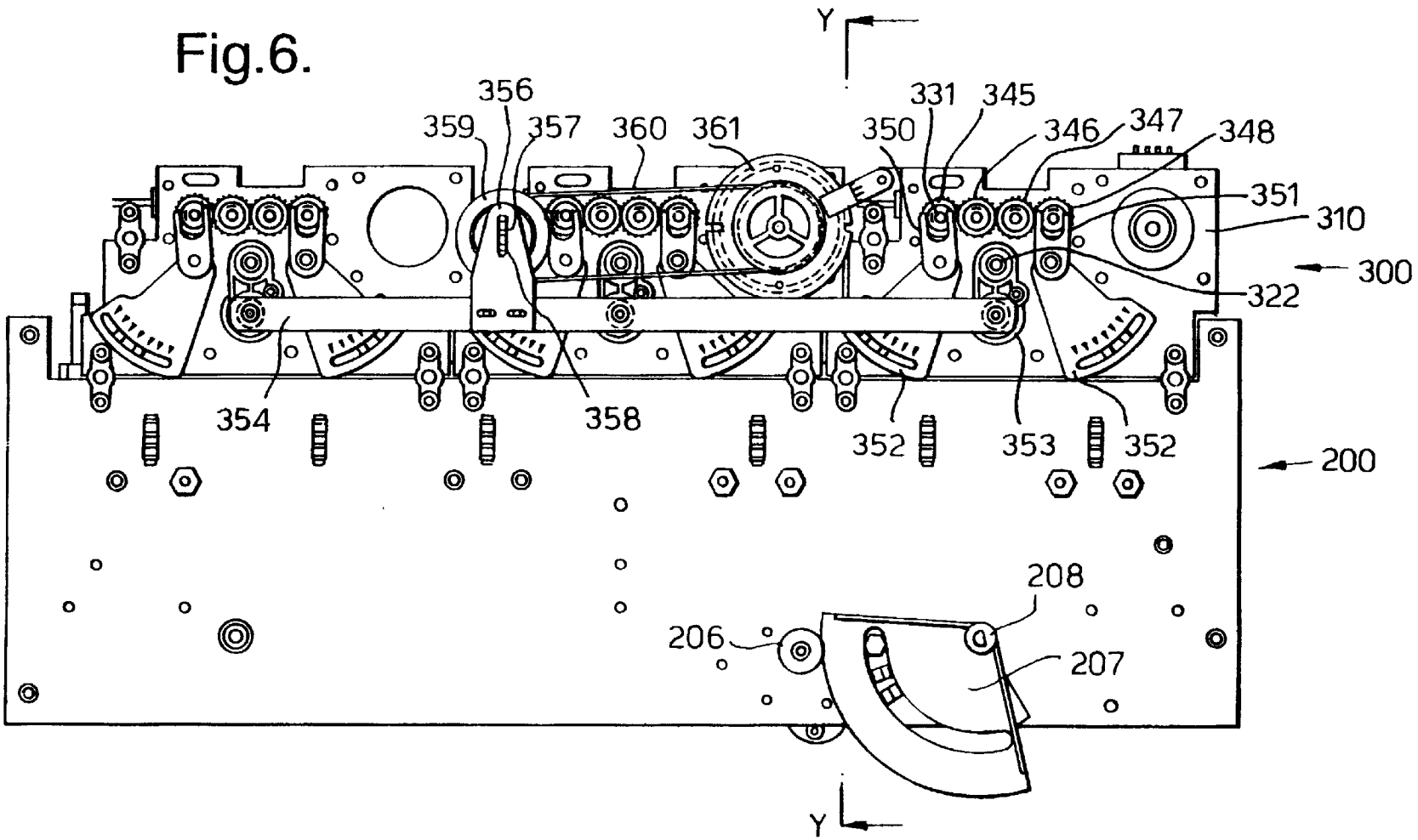
FIG. 6 is a view taken in the direction A in FIG. 5.
Figure 7:
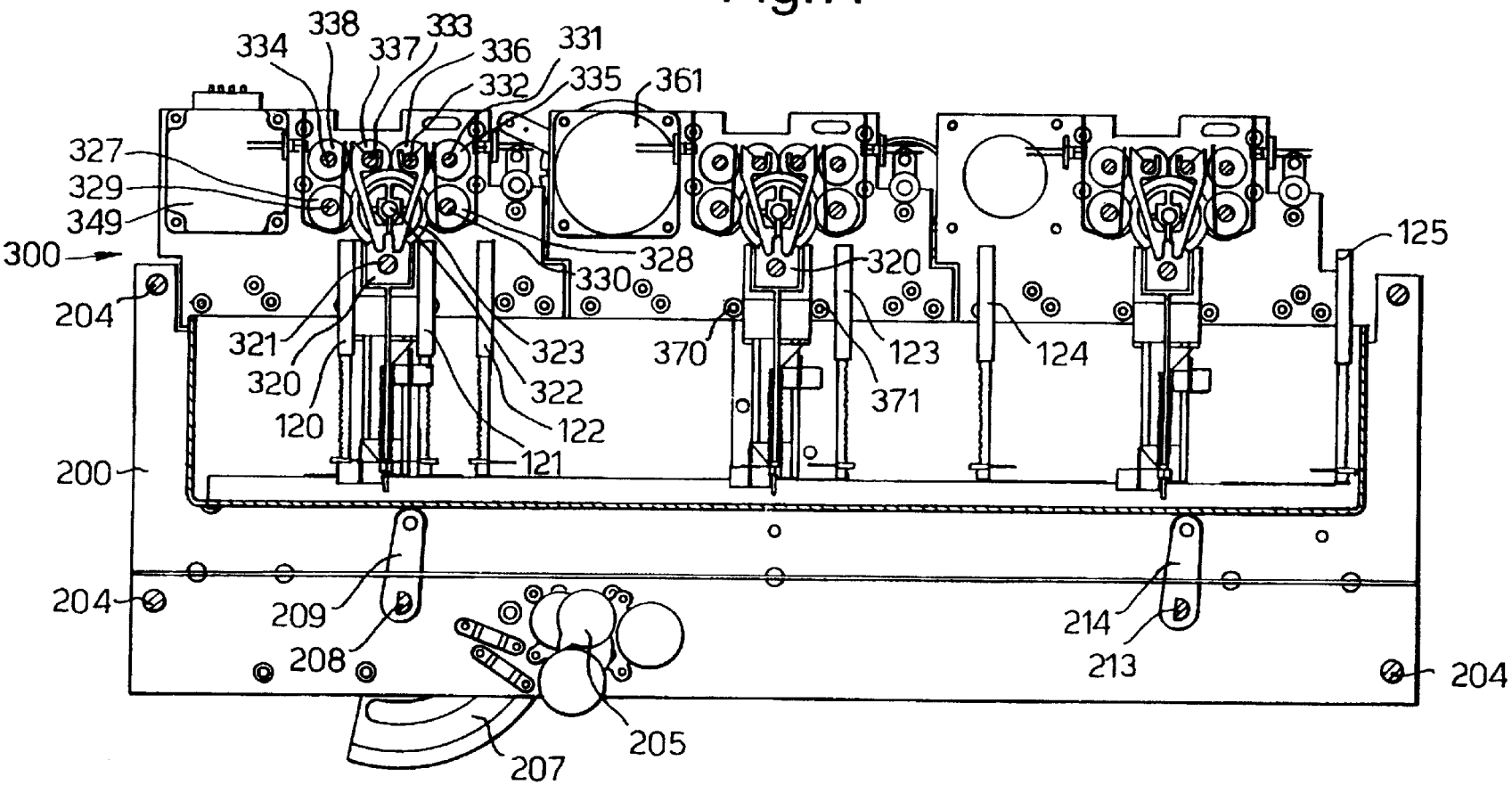
FIG. 7 is a section on the line B—B in FIG. 5.

As can be seen in FIG. 6, the shafts 331–334 extend through apertures in the side plate 310, the protruding sections carrying gears 345–348 respectively. One of these shafts, for example the shaft 331, is rotated by a drive belt (not shown) from the transport module 400 which itself is powered from a motor 349 attached to the inner face of the side plate 310. Rotation of the shaft 331 is communicated to the shafts 332–334 via the gears 345–348.

The shafts 329,330 and hence the contra-rotating rollers 327,328 are rotated in an indexed manner in a direction counter to the note feed direction, as will be explained below, via respective yokes 350,351 which extend around cams non-rotatably mounted to the shafts 331,334 respectively. The spacing between the contra-rotating rollers 327, 328 and the roller 323 is adjusted via conventional pivoted adjustment plates 352 attached to the side plates 310,311.

In order to control the location of the common feed rollers 320, the shaft 321 is mounted at each end on a respective link 353 pivoted from the shaft 322. The links 353 of each of the component sets 301–303 are connected by a respective connecting bar 354,355, each connecting bar carrying a bracket 356 having an elongate slot 357. The slot 357 receives a laterally extending pin 358 attached at a position offset from its axis to a pulley 359, the pulleys being connected via a shaft (not shown) extending between and rotatably mounted to the side plates 310,311. The pulley coupled with the bar 354 is driven via a belt 360 by a motor 361 attached to the inner face of the side plate 310. As the pulleys 359 are rotated, the pins 358 will oscillate up and down causing the plates 356 to move left and right thus causing corresponding movement of the bars 354,355. The bars cause the links 353 to pivot and hence cause the rollers 320 to move between a neutral position 362 shown in solid lines in FIG. 2, a left most position 363 in which the roller can feed sheets from the store 103 and a right most position shown in dashed lines 364 in which the feed member can feed sheets from the store 102.

The withdrawal module is also provided with a number of alignment pins 370,371, one pair of pins being provided corresponding to each set of common feed rollers 320 (FIGS. 5, 7 and 12), a pair of alignment pins being positioned opposite each other on each side plate 310,311 for each pair of common feed rollers. These alignment pins assist in locating the corresponding separating plates in the tray when the tray is lifted to its operative position, as will be described below.

Transport Module

The transport module will not be described in detail since its construction will be evident to a person of ordinary skill in the art. The module is shown schematically in FIGS. 1–4 and in a little more detail in FIG. 2. As can be seen in FIG. 2, the module comprises a set of roller pairs 420 around which are entrained respective belts 421–423. Only three such belts are shown in FIG. 2 although further sets will be provided in association with the stores 106,107. The upper part of each belt 423 cooperates with a further belt 424, part of which is shown in FIG. 2, the belt 424 being guided in part by rollers 425.

Sheets are conveyed from the withdrawal module 300 into the transport module 400 through nips between respective roller pairs 426,427;420,428 driven from the motor 349 by a drive belt (not shown).

Figure 2:
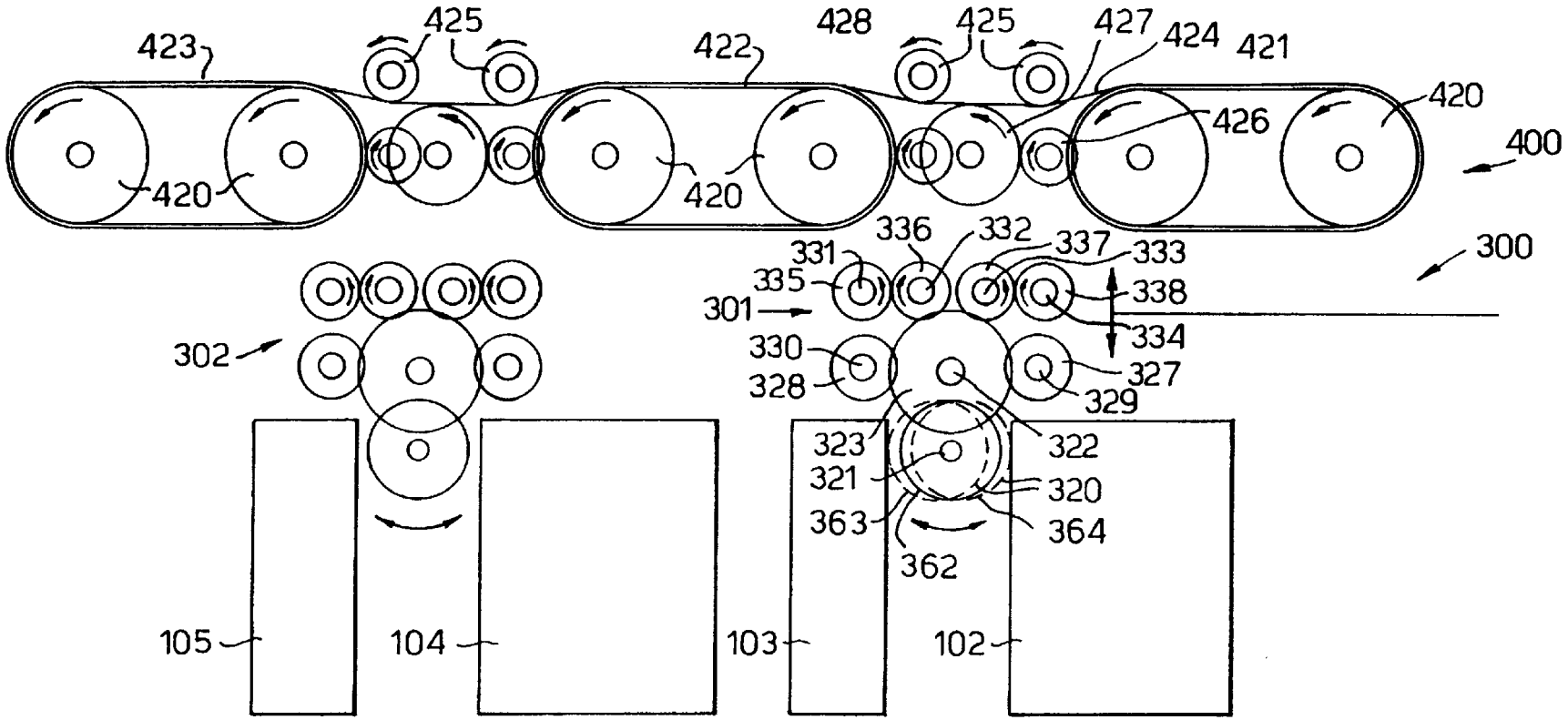
FIG. 2 illustrates the withdrawal and transport modules of FIG. 1 in more detail.

As can be seen more clearly in FIG. 1, sheets which have passed into the transport module 400 are then fed to a double detect system 430 and from there to a diverter 431 which responds to control signals derived from the double detect system 430 either to feed the sheets along a reject path 432 or along a dispense path 433 to a stacking wheel 434 mounted at the dispense outlet 420.

Relect Tray

Figure 3:
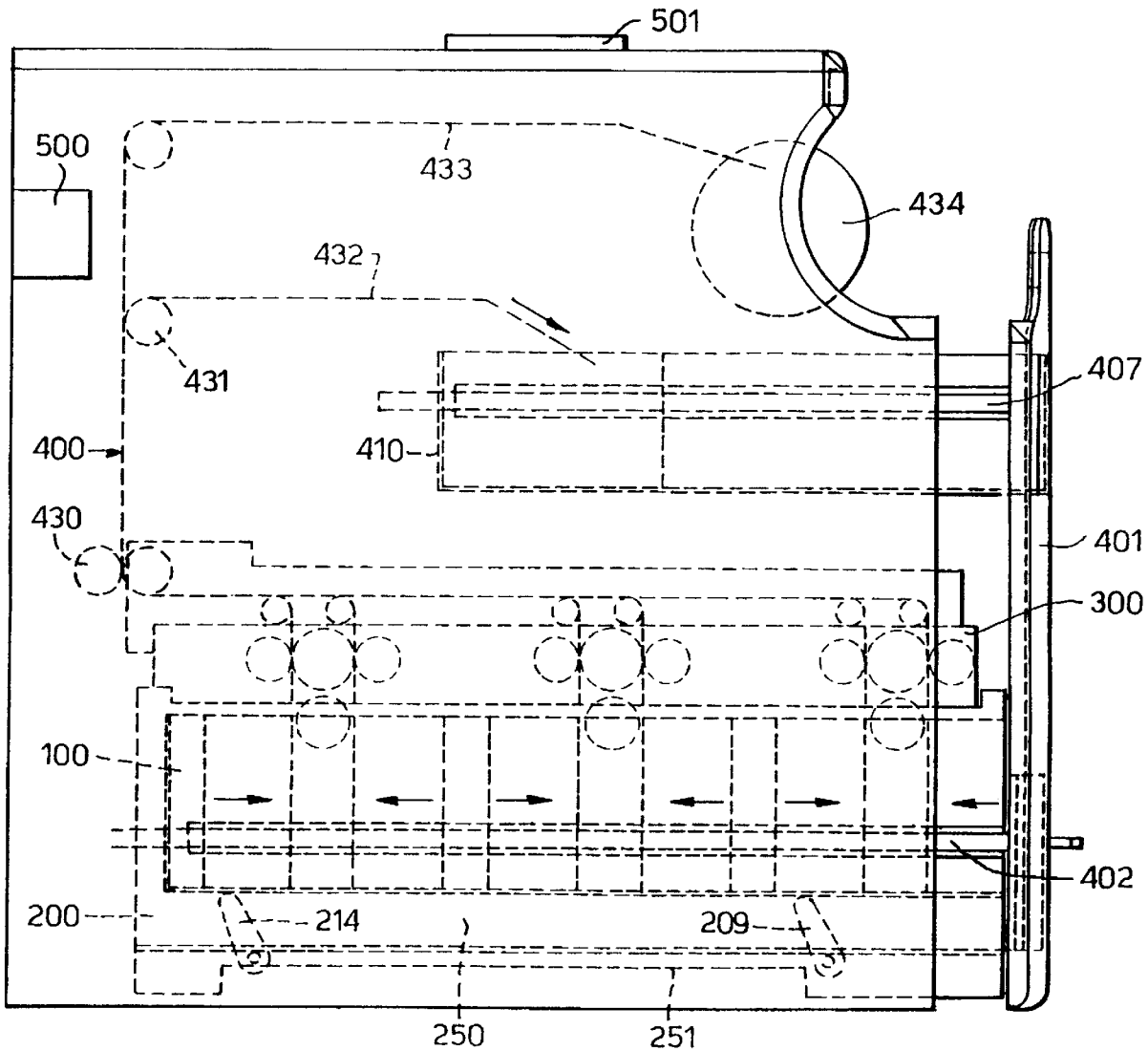
FIG. 3 is a view similar to FIG. 1 but showing the front panel partially pulled away.

The door or front panel 401 of the housing 1 is mounted on inner members of the slides 402, the outer members of which are attached to opposite sides of the housing 1. This enables the front panel 401 to be slid between a closed position shown in FIG. 1 in which it can be locked to the housing 1 and open positions, one of which is shown in FIG. 3. Also attached to the inner slide members of the slides 402 is the lifting module 200 into which the tray 100 can be inserted/removed through an opening 403 in the front panel 401. The opening 403 is closed by an access panel 404 which locks into the front panel 401.

Figure 4:
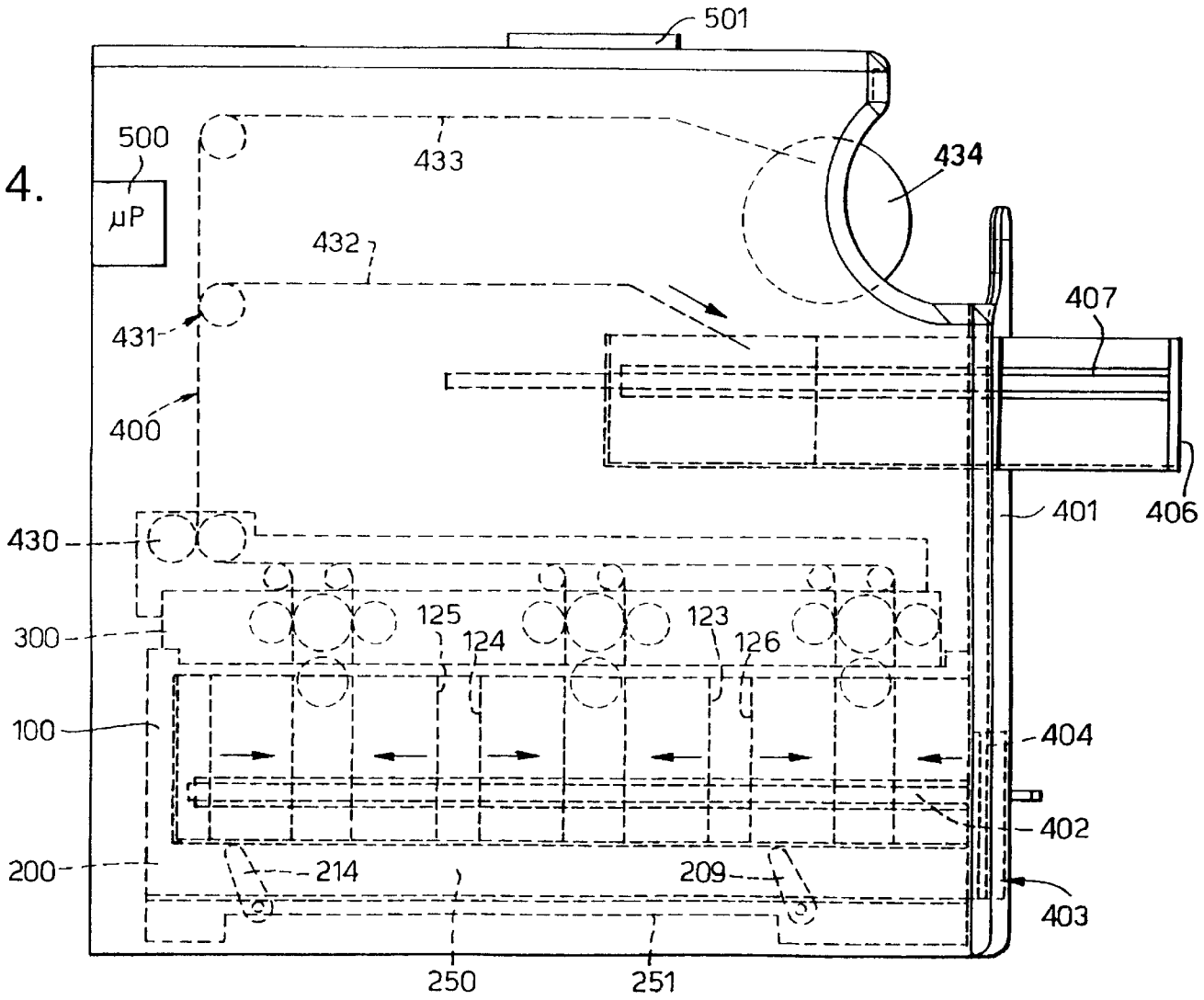
FIG. 4 is a view similar to FIG. 1 showing the reject tray partially opened.

Access to the reject tray 410 or drawer, is achieved via a panel 406 which can be locked into the front panel 401 and which is mounted to the inner members of a pair of slides 407, the outer members of which are attached to opposite sides of the housing 1. The reject tray 7 is also mounted on the slides 407. When the panel 406 is unlocked from the front panel 401, the panel 406 together with the reject tray 410 can be pulled away from the front panel 401 as shown in FIG. 4.

The reject tray 410 or drawer, comprises two sections 480,481, the section 480 being used for the storage of rejected sheets, and the section 481 being used for the manual storage of coin and/or sheet currency and/or other documentation placed therein by the teller.

In one arrangement, the position of the reject tray 410 is used to control operation of the dispensing apparatus. Thus, a monitoring device 405 mounted to the front panel 401 detects when the panel 406 is opened and this allows the dispensing apparatus to be activated. The advantage of this is that the teller can prevent operation of the machine simply by closing the access panel 406.

Control System and Method of Operation

Overall control of the dispensing apparatus is provided by a microprocessor 500 mounted to the housing 1. The microprocessor 500 is connected to an input device such as a keypad 501 mounted on top of the housing 1 and is also connected to the drive motors 205, 340, 349 and 361, the monitoring device 405, the double detect system 430 and the diverter 431. For simplicity, these connections have not been shown in the drawings.

Before the tray 100 is loaded into the apparatus, the operator indicates via the input device 501 to the microprocessor 500 that a loading operation is to be initiated and the microprocessor 500 will activate the motor 205 to rotate the lifting arms 209,214 out of the upper section 250 of the lifting module 200. When the lifting arms 209,214 are retracted, the tray 100 can be slid into the lifting module without being interfered with by the common feed rollers 320. The tray 100 is inserted between the side retainers 221 until the rear face 161 of the moulding slot 162 meets the locators 224 at which time a sensing device (not shown) detects the tray position (the "second position"), the sensing device being connected to the microprocessor 500. Upon detection of this condition, with the front panel 401 of the container 1 and panel 404 closed and locked into the front panel 401, the microprocessor 500 causes the motor 205 to raise the link arms 209,214 so that the tray 100 is raised to its feed position (or "first position") as shown in FIGS. 1 to 4 with the feed rollers 320 in their neutral position 362, not engaging sheets in either store.

As the tray is raised towards the withdrawal module 300, respective shoulders 177,178 on each of the separating plates 110–112 will pass between corresponding pairs of alignment pins 370,371. If, however, there is a slight misalignment, then one of the shoulders 177,178 will engage the corresponding alignment pin 370,371 causing the plate 110–112 to pivot about the pivot 171 back towards its correct position. This correct position may have the separating plates substantially vertical as shown in the drawings or possibly slightly offset from the vertical if there is a small misalignment between the separating plates and the common feed rollers 320.

When it is desired to remove the tray 100, this sequence of operation is reversed.

When the operator is ready to allow sheets to be dispensed, the panel 406 is unlocked from the front panel 401 and the tray 410 partially withdrawn as shown in FIG. 4. This condition is sensed by the microprocessor 500 via the sensor 405 and the microprocessor 500 will then respond to requests for the dispensing of combinations of banknotes input via the keypad 501 to activate the withdrawal and transport systems 300,400 accordingly. For example, if a dispense request requires that one banknote is extracted from the store 107 and a second banknote from the store 102, the systems will be actuated as follows. Initially, the microprocessor 500 will activate the motor 349 which will cause rotation of the transport module components and also rotation of the rollers 335–338 of each of the sets of components 301–303. The microprocessor 500 will then activate the motor 361 to cause the arms 354 to be moved so as to move the common feed rollers 320 from their neutral positions 362 to the left as shown in FIG. 2 to bring them into contact 363 with respective stacks of sheets and in particular to bring the feed rollers 320 of the components 303 into contact with sheets in the store 107 by protruding through slots 112C, 112E. The microprocessor 500 will then activate the motor 340 of the components 303 to cause clockwise rotation of the rollers 320 (as seen in FIG. 1) which will cause the sheet which is engaged by the rollers 320 to be fed upwards as shown in FIGS. 1 to 4 and through the gaps between the separator rollers 323 also being rotated clockwise and contra-rotating rollers 328 being indexed in an anti-clockwise direction. This will prevent more than one sheet being fed. The sheet continues to be fed upwardly and will pass through a nip defined by the rollers 335,336 of the withdrawal module and then on into the belt transport region of the transport module 400 between rollers 420,428 as shown in FIG. 2. The note then passes through the double detect system 430 and if a single note is detected, the note is then fed along a dispense path 433 to the stacking wheel 434 at the outlet 420. If, however, the double detect system 430 detected a double fed note, the diverter 431 would be activated accordingly by the microprocessor 500 to divert the note along the reject path 432 to the section 480 of the reject tray 410.

Once the sheet has been fed, the motor 340 of the components 303 is deactivated to stop rotation of the feed rollers 320 and then the motor 361 is activated to pivot the common feed rollers 320 into engagement with the opposite sheet stores and in particular to bring the common feed rollers 320 of the components 301 into contact with sheets in the store 102 in position 364. The motor 340 of the components 301 is then activated to rotate the common feed rollers 320 in an anti-clockwise direction (as seen in FIG. 1) so that a sheet is withdrawn upwardly from the store 102 and through the gaps between the separator rollers 323 also being rotated anti-clockwise and the contra-rotating rollers 327 being indexed in a clockwise direction. This sheet is then passed through the nip defined by the rollers 337, 338 of the withdrawal module and then between rollers 426, 427 of the transport module 400 from where it is then onward processed again as before described.

At the end of the dispense operation the rollers 320 will be returned to their neutral positions 362.

In general, it will be understood that although belt and roller systems have been shown for the various components, these could be interchanged or indeed replaced wholly or partially by vacuum feed systems.

It should also be understood that for the purposes of clarity, certain components have been omitted from a number of the drawings.

Although it is preferred the rollers mentioned above are in pairs on each shaft, each roller of a pair being substantially equi-spaced about a centre line, it is understood that more than two rollers could as well be used on each shaft and/or a single roller per shaft, positioned substantially on the lateral centre line could also be used.

In some cases the feed rollers 320 could be continuously rotated and movement between the feed and neutral positions used to control the individual note feeding.

In the event that the tray 100 is required to be opened or withdrawn before a dispense operation has been completed, the feed system can be operated in reverse to return any sheets in the transport/feed system to the appropriate store first to ensure that the tray can be removed without problems.

Figure 16:
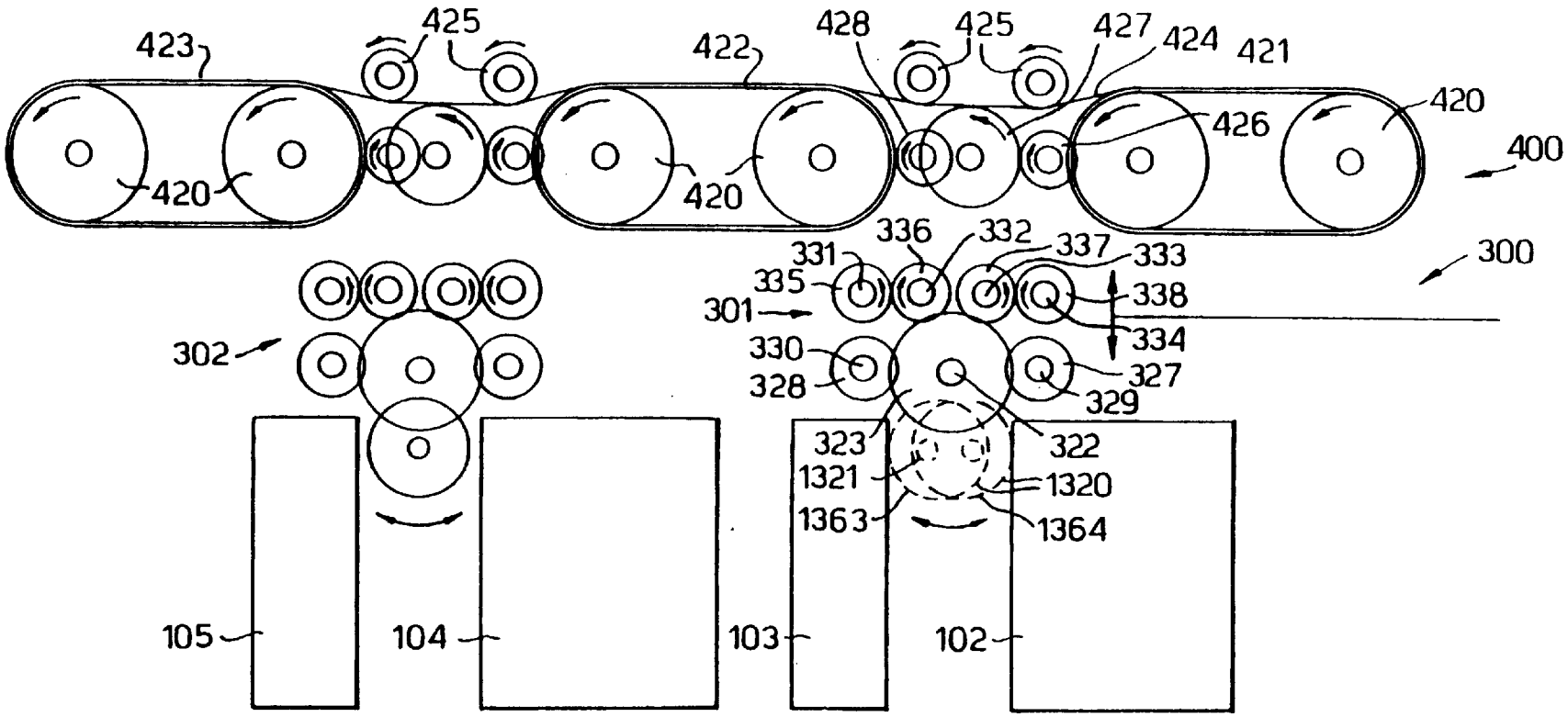
FIG. 16 is a view similar to FIG. 2 but of a further example.

An example of sheet dispensing apparatus according to the second aspect of the invention is shown in FIG. 16. In this embodiment, the apparatus is similar to that described with reference to FIGS. 1 to 15, with identical reference numerals denoting identical components.

In contrast to the example according to the first aspect of the invention, no neutral position 362 is provided for the feed rollers 1320. Each roller 1320 is therefore movable between a left most position 1363 and a right most position 1364 only. In this case, the motor 340 is coupled to the shaft 341 via a clutch mechanism 390 which operates to selectively disengage the motor 340 from the shaft 341 so that the rollers are able to rotate freely.

Operation of the apparatus according to the second aspect of the invention is similar to the operation according to the first aspect of the invention. However when a tray is to be loaded, the rollers 1320 will no longer be a neutral position such that the rollers do not engage the sheets in either store. Accordingly, the microprocessor 500 ensures that the clutch mechanism is disengaged such that the rollers 1320 "free wheel" on the shaft 1321. Thus, when the microprocessor 500 causes the motor 205 to raise the link arms 209,214 so that the tray 100 is raised to its feed position (or "first position") as shown in FIG. 2 even though the sheets of the stack engage with the surface of the respective roller 1320, the rollers free wheel such that no undue stresses are placed on the sheet. The clutch is then engaged.

Upon request for a bank note, the microprocessor 500 will activate the withdrawal and transport systems 300,400 accordingly. For example, if a dispense request requires that one banknote is extracted from the store 107 the systems will be actuated as follows. Initially, the microprocessor will activate the motor 349 which will cause rotation of the transport module components and also rotation of the rollers 335–338 of each of the sets of components 301–303.

The microprocessor 500 will then activate the motor 361 to cause the arms 354 to be moved so as to move the common feed rollers 320 to the left most position 363 as shown in FIG. 2. If the rollers 1320 are already in the left most position 363, then the rollers will remain in that in position. The rollers will then contact the respective stack of sheets and in particular the feed rollers 1320 will contact with sheets in the store 107 by protruding through slots 112C,112E.

The microprocessor 500 will then activate the motor 340 of the components 303 to cause clockwise rotation of the rollers 1320 (as seen in FIG. 16) which will cause the sheet which is engaged by the rollers 1320 to be fed upwards as shown in FIG. 16 and through the gaps between the separator rollers 323 also being rotated clockwise and contra-rotating rollers 330 being indexed in an anti-clockwise direction. This will prevent more than one sheet being fed.

The sheet continues to be fed upwardly as described with respect to the previous embodiment.

What is claimed is:

1. Sheet dispensing apparatus comprising at least one pair of sheet stores; and a transport system for transporting sheets from the stores to a dispense position, the transport system including, for each pair of sheet stores, a common feed member which, upon relative movement between the common feed member and the stores in a first direction, can be moved between a pair of feed positions in each of which it engages a sheet in a respective one of the pair of stores so as to enable sheet(s) to be withdrawn from the corresponding store, characterized in that the apparatus further comprises an adjustment system for causing relative bodily movement between the stores and the common feed member in a second direction substantially transverse to said first direction so that the stores and the common feed member can be arranged relative to each other in a first position to enable the common feed member to be moved into engagement with sheets in either store, and in a second position in which the common feed member cannot be moved into engagement with sheets in either store.

2. Apparatus according to claim 1, further comprising a driving means which drives the common feed member; and a clutch mechanism which uncouples the common feed member from the driving means.

3. Apparatus according to claim 1, wherein in the second position the stores can be laterally removed from the remainder of the apparatus.

4. Apparatus according to claim 1, wherein the or each pair of stores is provided in a tray slidably mounted relative to the common feed member.

5. Apparatus according to claim 1, wherein the adjustment system comprises one or more pivoted arms coupled with a drive motor operable selectively to pivot the arms so as to cause bodily movement of the stores to the first position.

6. Apparatus according to claim 1, wherein the common feed member is formed by one or more rollers.

7. Apparatus according to claim 1, wherein the common feed member is connected to a drive motor for rotation in either direction depending on the store from which sheets are to be withdrawn.

8. Apparatus according to claim 1, wherein the common feed member is movable between the feed positions.

9. Apparatus according to claim 8, wherein the common feed member is coupled to a pivoted link.

10. Apparatus according to claim 1, wherein each store comprises a separator plate and a pressure member for urging a stack of sheets in the store against the separator plate.

11. Apparatus according to claim 10, wherein the separator plate is movable to bring the selected stack into contact with the common feed member.

12. Apparatus according to claim 10, wherein the separator plates are positioned adjacent one another but spaced apart.

13. Apparatus according to claim 1, wherein each store has a base which is adjustable so as to adjust the location of sheets in the store relative to the common feed members.

14. Apparatus according to claim 1, wherein the transport system includes a sheet separator roller downstream of the common feed member to prevent more than one sheet from being fed, the sheet separator roller being mounted for rotation in either direction dependent on the store from which sheets are withdrawn.

15. Apparatus according to claims 1, further comprising a reject location to which rejected sheets can be selectively fed by the transport system.

16. Apparatus according to claim 15, further comprising a drawer positioned at the reject location, and means for monitoring the position of the drawer, the monitoring means being connected to a control system of the transport system, the control system only allowing the transport system to be operated when the drawer is partially open.

17. A banknote dispenser including sheet dispensing apparatus according to claim 1.

18. Apparatus according to claim 14, wherein the tray comprises a base; and at least two sheet stores spaced apart along the base, each store including an upright support plate, and a pressure member for urging a stack of sheets along the base against the support plate.

19. Apparatus according to claim 1, wherein the adjustment system causes the common feed member, when the common feed member and the stores are in their first relative position, to take up a neutral position in which the common feed member cannot feed sheets from either store.

20. Apparatus according to claim 19, wherein in the second position the stores can be laterally removed from the remainder of the apparatus.

21. Apparatus according to claim 19, wherein the or each pair of stores is provided in a tray slidably mounted relative to the common feed member.

22. Apparatus according to claim 21, wherein the tray comprises a base; and at least two sheet stores spaced apart along the base, each store including an upright separator plate, and a pressure member for urging a stack of sheets along the base against the separator plate.

23. Apparatus according to claim 19, wherein the adjustment system comprises one or more pivoted arms coupled with a drive motor operable selectively to pivot the arms so as to cause bodily movement of the stores to the first position.

24. Apparatus according to claim 19, wherein the common feed member is formed by one or more rollers.

25. Apparatus according to claims 19, wherein the common feed member is connected to a drive motor for rotation in either direction depending on the store from which sheets are to be withdrawn.

26. Apparatus according to claim 19, wherein the common feed member is movable between the feed positions.

27. Apparatus according to claim 26, wherein the common feed member is coupled to a pivoted link.

28. Apparatus according to claim 19, wherein each store comprises a separator plate and a pressure member for urging a stack of sheets in the store against the separator plate.

29. Apparatus according to claim 28, wherein the separator plate is movable to bring the selected stack into contact with the common feed member.

30. Apparatus according to claim 28, wherein the support plates are positioned adjacent one another but spaced apart.

31. Apparatus according to claim 19, wherein each store has a base which is adjustable so as to adjust the location of sheets in the store relative to the common feed members.

32. Apparatus according to claim 19, wherein the transport system includes a sheet separator roller downstream of the common feed member to prevent more than one sheet from being fed, the sheet separator roller being mounted for rotation in either direction dependent on the store from which sheets are withdrawn.

33. Apparatus according to claim 19, further comprising a reject location to which rejected sheets can be selectively fed by the transport system.

34. Apparatus according to claim 33, further comprising a drawer positioned at the reject location, and means for monitoring the position of the drawer, the monitoring means being connected to a control system of the transport system, the control system only allowing the transport system to be operated when the drawer is partially open.

35. A banknote dispenser including sheet dispensing apparatus according to claim 19.

* * * * *